US006851365B2

(12) United States Patent
Jentzsch

(10) Patent No.: US 6,851,365 B2
(45) Date of Patent: Feb. 8, 2005

(54) METHOD FOR PRODUCING MULTICOLOR PRINTING

(75) Inventor: Arndt Jentzsch, Coswig (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 373 days.

(21) Appl. No.: 09/774,574

(22) Filed: Feb. 1, 2001

(65) Prior Publication Data

US 2002/0015164 A1 Feb. 7, 2002

(30) Foreign Application Priority Data

Feb. 2, 2000 (DE) ..... 100 04 573

(51) Int. Cl.[7] ..... B41N 3/00

(52) U.S. Cl. ..... 101/456; 101/467; 101/478; 101/463.1

(58) Field of Search ..... 101/456, 467, 101/478, 463.1, 425

(56) References Cited

U.S. PATENT DOCUMENTS 4,116,715 A * 9/1978 Smiggen et al. ..... 134/6
4,718,340 A * 1/1988 Love, III ..... 101/116
5,623,877 A * 4/1997 Muth ..... 101/486
5,701,170 A * 12/1997 Powers et al. ..... 355/40
6,082,263 A * 7/2000 Koguchi et al. ..... 101/456
6,112,664 A * 9/2000 Naniwa et al. ..... 101/463.1
6,510,795 B1 * 1/2003 Detmers et al. ..... 101/480

FOREIGN PATENT DOCUMENTS

EP 940252 A1 * 9/1999 ..... B41F/7/02

* cited by examiner

*Primary Examiner*—Andrew H. Hirshfeld
*Assistant Examiner*—Andrea H. Evans
(74) *Attorney, Agent, or Firm*—Jones, Tullar & Cooper PC

(57) ABSTRACT

A method for producing multicolor printing, by using printing plates provided digitally with images and/or print, represents an efficient solution for multi-color printing, in particular in a large format. Printing plates, which had been used in a printing press, are removed from the printing form cylinders, are sent to a device for neutralization, and are neutralized. The neutralized printing plates are fixed at correct registration in an exposure and development unit where they are exposed and developed. The printing plates provided with new images are again applied to the printing form cylinder.

4 Claims, No Drawings

METHOD FOR PRODUCING MULTICOLOR PRINTING

FIELD OF THE INVENTION

The present invention is directed to a method for producing multicolor printing. Coated printing plates are provided digitally with images and/or print in correct registration in an exposure and development unit. These printing plates can be re-used.

BACKGROUND OF THE INVENTION

In the prior art, the direct illustration of printing formes from a digital data store from the pre-print stage, such as the prepress area, takes place by the utilization of one of three systems as discussed in the publication Teschner, "Offsetdruck-technik" [Offset Printing Techniques], 1995, publ. by Fachschriftenverlag. These three systems are as follows:

Transferring all digital image data for all ink colors to individual printing plates outside of the printing press= computer-to-plate.

Transferring all digital image data for all ink colors to several printing plates in the printing press=computer-to-press.

Transferring all digital image data for all ink colors to re-writable printing forme cylinders, such as image carrier drums in the printing press=computer-to-print While disposable printing plates; i.e. printing plates that cannot be used again, are employed with the first two systems set forth above, no printing plates are used with the third system. Instead, the printing forme cylinder itself is provided with images.

It is a limitation of these prior art systems that none of the three above-described systems offers an efficient solution, in particular in connection with multicolor printing in a large format.

OBJECT AND SUMMARY OF THE INVENTION

It is the object of the present invention to provide a method which accomplishes an efficient solution for multicolor printing, in particular in a large format.

In accordance with the present invention, this object is attained by the provision of a method for producing multicolor printing using printing plates provided digitally with images and/or print. Previously used printing plates are removed from a forme cylinder and are neutralized in a suitable neutralizing device. This neutralization removes the prior images or print. These plates may then be coated and the now neutralized and possibly coated plates are placed, in correct registration, in an exposure and development unit. The plates are then exposed and developed. These plates, which have now been provided digitally with new images and/or print are then again applied to the printing forme cylinder.

DETAILED DESCRIPTION OF THE PREFERRED EMBODIMENT

At the conclusion of the production of a multi-color printing task or job in a printing press, the printing plates that were used for the multi-color printing job are removed from the printing forme cylinders on which they had been clamped. This plate removal is typically accomplished through the use of automatic plate-changing devices, with which the used printing plates are removed from the printing forme cylinders. These automatic plate-changing devices then are used to also supply fresh printing plates to the printing forme cylinders.

Once they have been removed from the printing forme cylinders, the used printing plates are then conducted to a device for neutralizing the used printing, plates and are neutralized there. In this context, neutralization of the plates is understood to mean that the previously used printed image and/or print is removed from the printing plates. This removal takes place by the use of a chemical, a mechanical or a thermal process, and preferably by the use of laser techniques. An essentially even surface tension is achieved by the neutralization.

Thereafter, the now neutralized or cleaned printing plate is again provided with new images and/or print. This provision of new images and/or prints may take place in one way directly, for example by the use of an ink jet printer or a transfer tape, or in another way by the use of a pre-applied imprinting of the printing plate; i.e. lacquer and photosensor device or thermal layer. This application of new images and/or print onto the printing plate takes place digitally from digital data sets (CtP).

In order to assure the capability of the newly applied images and/or prints placed on the printing plates to be in proper alignment or registration when the printing plates are re-installed on the printing forme cylinder, the printing plate must be situated in place in the exposure unit in proper registry by use of the registration system of the printing itself, or through the use of a second registration system which makes reference to the registration system of the printing plate. This second registration system must be designed to be dimensionally stable.

Following the application of these new images and/or print, including their development, the printing plates are again brought to the printing forme cylinder, and are re-installed on the printing forme cylinder preferably by operation of the automatic plate-changing device.

The printing plate used for this method is preferably made of special steel, is dimensionally stable and is free of depressions. This printing plate can be provided with further improvements of the surface known for offset printing, for example a chromium layer.

While a preferred embodiment of a method for producing multicolor printing in accordance with the present invention has been set forth fully and completely hereinabove, it will be apparent to one of skill in the art that various changes in, for example the material to be printed, the specific type of press and the like could be made without departing from the true spirit and scope of the present invention which is accordingly to be limited only by the following claims.

What is claimed is:

1. A method of producing multicolor printing using printing plates provided digitally with images and/or print including:

providing a printing forme cylinder adapted for receiving printing plates;

providing a registration system for said printing plates;

removing printing plates used in a previous printing task from said printing forme cylinder;

providing a printing plate neutralizing device useable to remove images and print from said previously used printing plates;

locating said printing plate neutralizing device separate from said printing forme cylinder;

conducting said previously used printing plates from said printing forme cylinder to said printing plate neutralizing device;

neutralizing said previously used printing plates in said printing plate neutralizing device by removing used images and print from said previously used printing plates;

applying a coating to said previously used and neutralized printing plates;

providing a printing plate exposure and development unit;

securing said neutralized and coated printing plates in proper registration in said exposure and development unit using said registration system;

providing new images and print to said neutralized and coated printing plates in said exposure and development unit;

developing said new images and print applied to said neutralized and coated printing plates in said exposure and development unit;

returning said neutralized and coated printing plates provided with said new images and print to said printing forme cylinder; and re-applying said neutralized and coated printing plates with said new images and print to said printing forme cylinder.

2. The method of claim 1 further including providing an automatic plate changing device and using said automatic plate changing device for removing printing plates from said printing forme cylinder and for re-applying printing plates to said printing forme cylinder.

3. The method of claim 1 further including neutralizing said used printing plates using a laser neutralization technique.

4. The method of claim 1 further including providing an exposure and development unit registration system, and securing said printing plates in proper registration in said exposure and development unit using said exposure and development unit registration system and said printing plate registration system.

* * * * *